United States Patent [19]

Lahde

[11] 4,344,467

[45] Aug. 17, 1982

[54] DEVICE FOR CHARGING CONTAINERS WITH AN INERT GAS

[76] Inventor: Frank U. Lahde, 966 Hemlock, Rochester, Mich. 48063

[21] Appl. No.: 192,724

[22] Filed: Oct. 1, 1980

[51] Int. Cl.[3] ..... B65B 31/04

[52] U.S. Cl. ..... 141/66; 141/83; 141/197; 141/231; 141/367

[58] Field of Search ..... 53/503, 79, 403, 408; 141/4, 6, 7, 8, 48, 49, 54, 56, 63–66, 94–96, 83, 197, 231, 302, 392, 367; 222/3, 144, 5, 486; 239/390, 391, 397, 442, 436

[56] References Cited

U.S. PATENT DOCUMENTS 4,120,331 10/1978 Krivanek ..... 141/66

FOREIGN PATENT DOCUMENTS 446124 1/1948 Canada ..... 141/66

*Primary Examiner*—Frederick R. Schmidt

[57] ABSTRACT

A device for evacuating air from a receptacle containing deteriorative material and charging the receptacle with an inert gas. The device has a nozzle by which the receptacle may be charged. The nozzle is connected to a gas supply source having means for sensing air and gas contents and pressures. The device is operated to reduce the oxygen in the receptacle and discharge an inert gas into the receptacle while monitoring the oxygen content therein.

8 Claims, 4 Drawing Figures

DEVICE FOR CHARGING CONTAINERS WITH AN INERT GAS

SUMMARY OF THE INVENTION

This invention relates to a device for evacuating air from and charging a receptacle containing a deteriorative material with an inert gas, and especially to a device with monitoring means.

Previously, to package an article with an inert gas, it was necessary to utilize a number of pumps and hoses to evacuate air from a receptacle and then refill it with an inert gas. The present charging device simplifies the operation by utilizing a nozzle which is connected to a pump and to a switching unit by electrical connections. The device is designed to be used with various types of receptacles, including the receptacle and method described in the copending application of Larry M. Blad, Ser. No. 138,187, filed Apr. 7, 1980. The nozzle has individual fittings which carry sensors to determine the gas content of the receptacle. The sensors activate switches which open and close an oxygen evacuate circuit and switches which open and close an inert gas-fill circuit.

Accordingly, it is the primary object of this invention to provide novel and simple means to reduce the oxygen level of a receptacle containing deterioration material and introduce a selected inert gas while monitoring the oxygen content throughout the process.

Another object is to provide a novel means for charging a receptacle with an inert gas.

Still another object is to provide a receptacle charging device which utilizes a nozzle with air-evacuation and gas filling fittings which carry sensors to measure gas content of the receptacle.

Other objects will be obvious upon a reading of the following description.

DESCRIPTION OF THE PREFERRED EMBODIMENT

The preferred embodiment illustrated is not intended to be exhaustive or to limit the invention to the precise form disclosed. It is chosen and described in order to best explain the principles of the invention, its application and practical use, to thereby enable others skilled in the art to utilize the invention.

Figure 1:
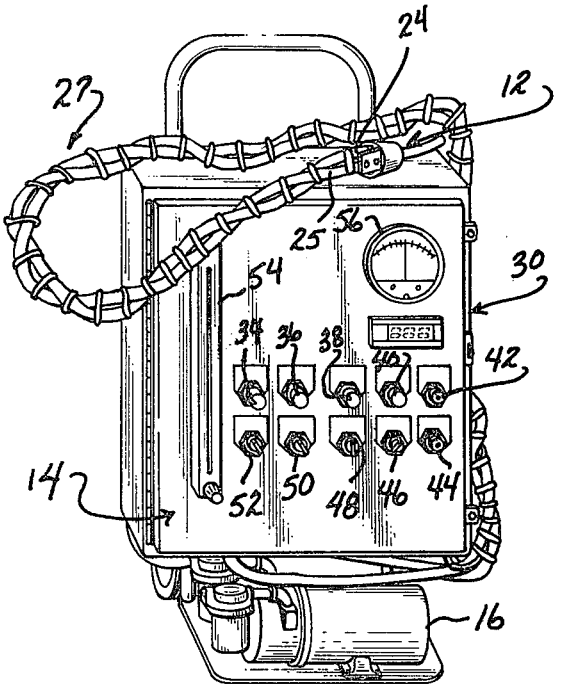
FIG. 1 is a perspective view of the control unit and pump of the charging device.
Figure 2:
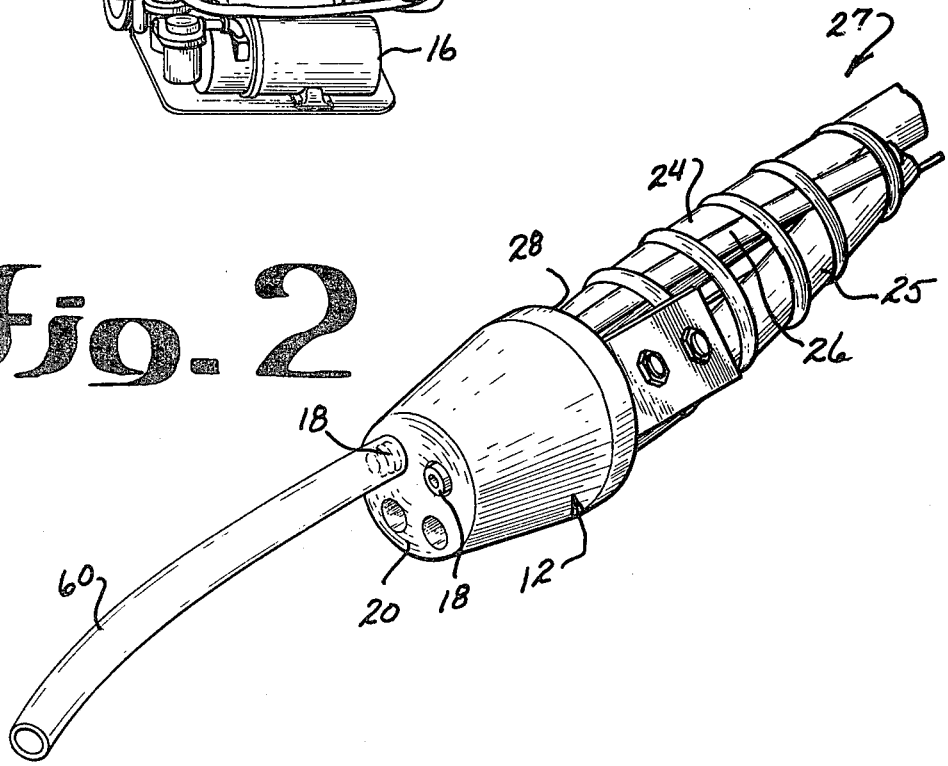
FIG. 2 is a perspective view showing the nozzle of the charging device.
Figure 3:
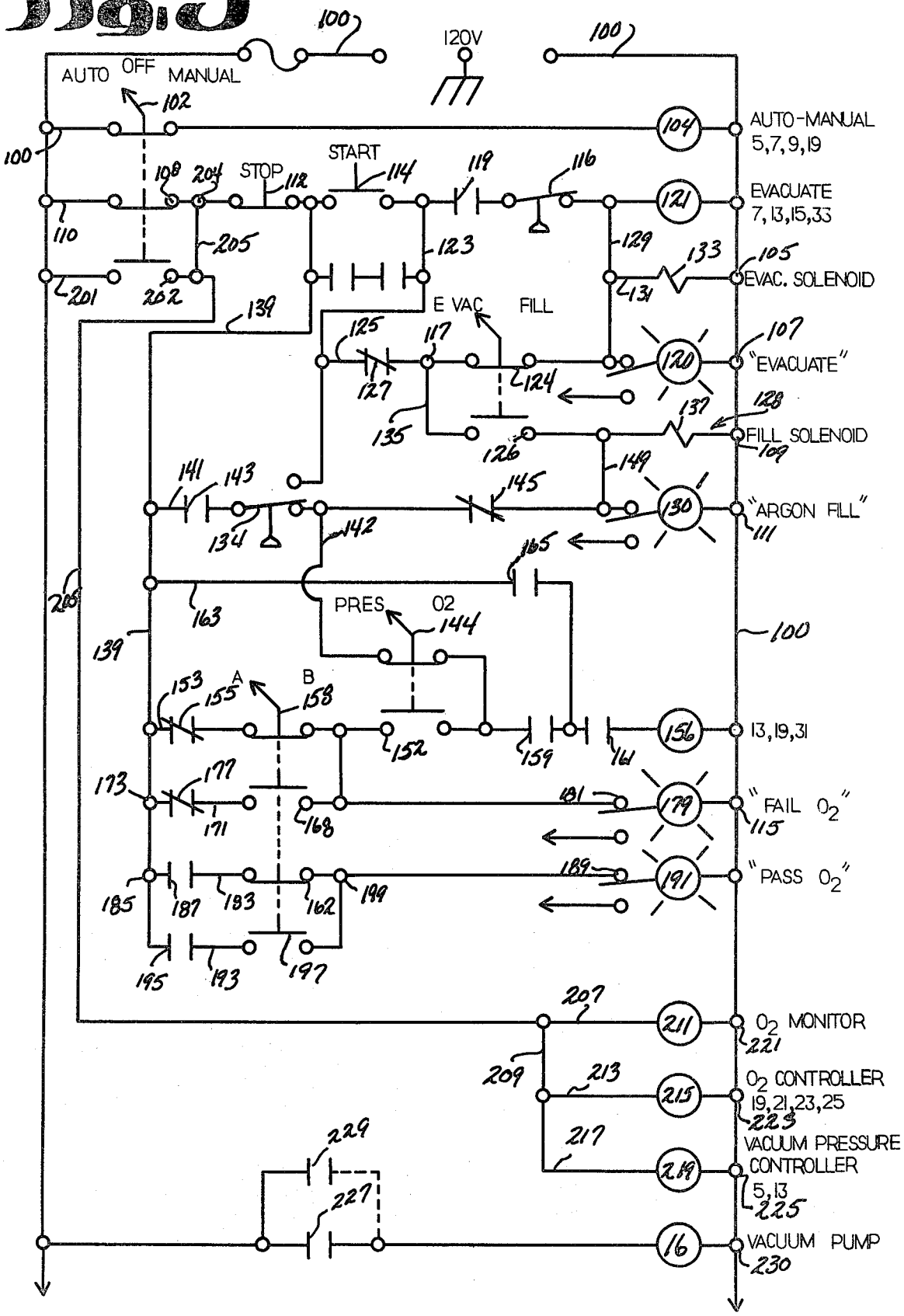
FIG. 3 is a diagram of the switching circuitry.

Referring to the drawings, the charging device 10 has a nozzle 12, a control unit 14, a gas source 15, and a pump 16. Nozzle 12 has a plurality of fittings 18 at its attaching face 20. Each fitting 18 has a sensor (not shown) associated therewith. A fill hose 24, an evacuation hose 25, and wires 26 are preferably bound together to form a cord 27 which extends from the rear face 28 of nozzle 12 and connects the nozzle to the control unit or switching device 14 and pump 16. Control unit 14 includes a cabinet 30 having a front plate 32. The container 30 houses the circuitry of the charging device 10, one example of which is depicted in FIG. 3. Container 30 mounts a plurality of indicating lights 34, 36, 38, 40; switches 42, 44, 46, 48, 50, 52; gauges 54, 56; valves; and a meter 58 which are combined and arranged to effectuate and indicate the operations of the charging unit 10.

Pump 16 is controlled by the components of the unit 14. An air evacuation hose 25 is connected to pump 16. A gas source 15 is connected by a hose 29 to the control unit 14 and the gas discharge nozzle 12.

In the circuitry, as illustrated in FIG. 3, the automatic-manual circuit 100 includes a three position, three pole selector control switch 102. Included in series with switch 102 in circuit 100 is a four pole relay 104.

A parallel circuit 110 is connected to circuit 100 and includes switches 108, 112, 114 and 116, condensor 119 and four pole relay 121. Switch 108 is connected to switch 102 for simultaneous and similar control thereof. A lead 123 branches from circuit 110 between switch 114 and condensor 119. A lead 125 branches from lead 123 and has interposed therein a condensor 127, a switch 124 and a signal light 120. A lead 129 branches from circuit 110 between switch 116 and relay 121 and is connected to lead 125 between switch 124 and light 120. A lead 131 containing resistor 133 is connected to lead 129 and connection 105 with lead 125 to dispose resistor 133 in parallel to light 120. A lead 135 branches from lead 125 between condensor 127 and switch 124 and has interposed therein a switch 126 correlated to but oppositely oriented relative to switch 124. Lead 135 includes a resistor 137 and solenoid 128 and is connected to lead 125 at 117. A lead 139 branches from lead 110 between switches 112 and 114 and has connection with a lead 141 in which a condensor 143, switch 134, condensor 145, and light 130 are connected. Lead 141 is connected to lead 135 at 109. A lead 149 is connected to lead 135 between switch 126 and resistor 137 and to lead 141 between condensor 145 and light 130.

A lead 153 extends from lead 139 and has interposed therein condensor 155, switches 158, 152, condensors 159 and 161 and three pole relay 156, lead 153 is connected to lead 141 at 111. A lead 163 branches from lead 139 and is connected to lead 153 between condensors 159 and 161, and has condensor 165 interposed therein. A lead 142 branches from lead 141 between switch 134 and condensor 145 and has switch 144 interposed therein and correlated with switch 152 to close when switch 152 is open. Lead 142 is connected to lead 153 between switch 152 and solenoid 159.

A lead 171 branches from lead 139 at 173 and has a condensor 177, switch 168 and lamp 179 interposed therein. Switch 168 is correlated with switch 158 to close when switch 158 is open. Lamp 179 includes a switch 181 between switch 168 and junction 115. Lead 183 branches from lead 139 at 185 and has a condensor 187, switches 162 and 189 and lamp 191 included therein. Switch 162 is interposed in conjunction with switches 158 and 168 to be open with switch 158. Lead 193 branches from lead 139 and has a condensor 195 and switch 197 interposed therein. Switch 197 is correlated with switch 168 and oppositely with switches 162 and 158. Lead 193 joins lead 183 at 199.

Lead 201 branches from circuit 100 and includes switch 202. Switch 202 is correlated with switches 102 and 108 to close when they are open. Lead 201 is connected to circuit 110 by lead 205 at 204. Lead 205 has leads 207 and 209 branch therefrom. Lead 207 includes relay 211 and joins circuits 100 at 221. Lead 213 branches from lead 209 with relay 215 interposed between lead 209 and junction 223. Lead 217 branches from lead 209 and has relay 219 interposed between lead 209 and junction 225. Circuit 100 directly connects with pump 16 at 230. Interposed therebetween are parallel condensors 229, 227.

It is understood that the preceding details are descriptive of one embodiment of the circuitry. Other embodiments may be used to effect the desired results.

Figure 4:
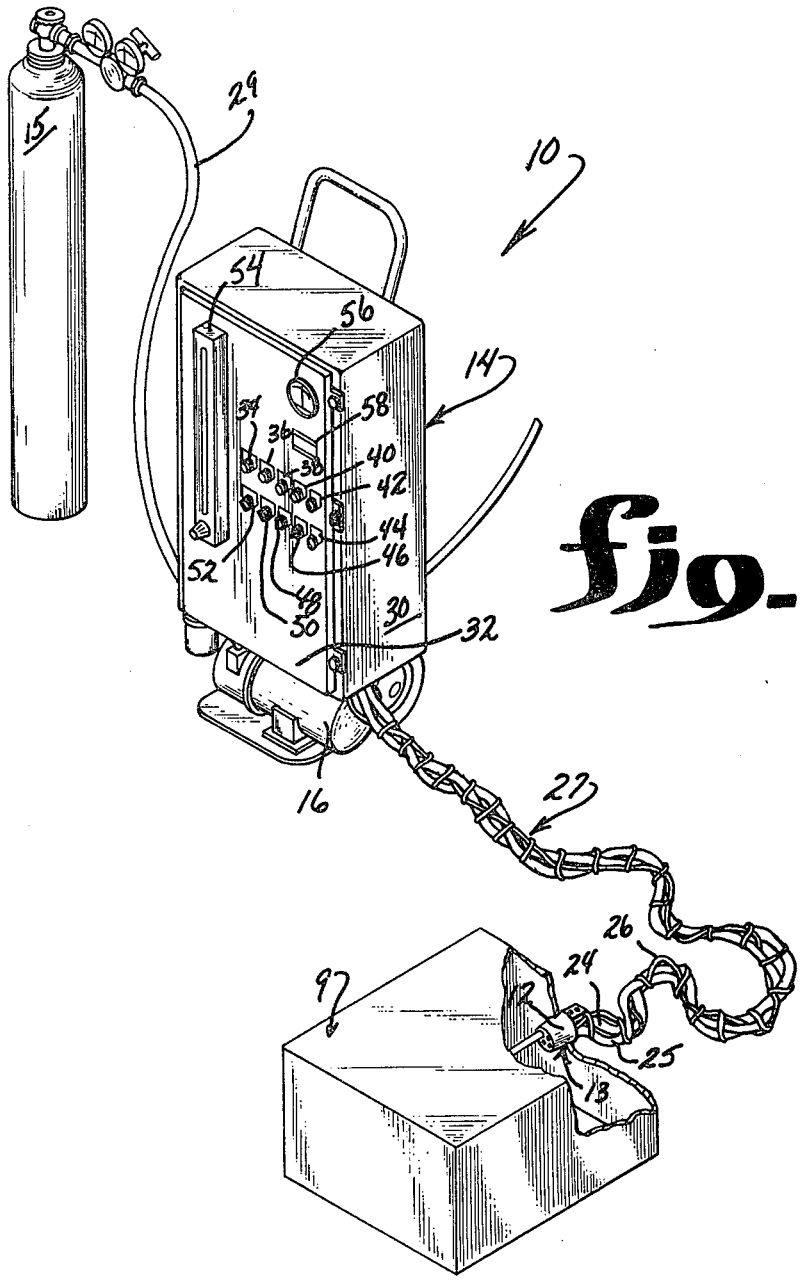
FIG. 4 is a schematic view of the charging device in use.

To utilize charging device 10 (as shown in FIG. 4) nozzle 12 is inserted in a receptacle 13 and the process of charging the package described in this aforementioned co-pending application. Ser. No. 138,187, incorporated herein by reference, begins. One fitting 18 of nozzle 12 has a conduit 24 attached thereto. The inert gas utilized in this charging process will pass through conduit 24 and nozzle 12 into the receptacle. The purpose of conduit 24 is to separate the introduction of the inert gas from the point at which oxygen ($O_2$) is removed from the receptacle as through conduit 25.

The basic operation of charging unit 10 is the same in all automatic modes. When start switch 42 is pressed (closed), evacuate lamp 34 is illuminated and pump 16 begins evacuation causing the bag-like package 9, attached to cable 27 to be evacuated to a preset vacuum level. Pump 16 evacuates oxygen from package 9 through evacuation hose 25. When the preset level of oxygen is attained, the evacuation lamp 34 goes out, and vacuum pump 16 shuts down. At this point, fill lamp 36 illuminates and the gas-fill solenoid is opened. With the opening of this solenoid, the pump unit 16 reverses operation and draws inert gas through hose 29 from gas source 15, and pumps it through hose 24 into package 9. When a predetermined pressure or amount of inert gas is present in package 9, a sensor within one of the fittings 18 opens the fill switch to shut off the gas supply and terminate the charging process. The inert gases which may be used in this embodiment include Nitrogen, Xenon, Argon, Radon, Krypton and Neon.

It is to be understood that the preceding is a description of only one mode of package charging. In all of the modes, the oxygen level of the bag is continuously monitored and displayed, and depending on the mode, controlled. The oxygen level sensor is mounted or positioned to monitor the actual oxygen level in the mouth of the bag. The vacuum and pressures within the bag are monitored via a sensing line 26 which runs from nozzle 12 to control unit 14, thereby monitoring the actual vacuum or pressure level in the mouth of the bag or package. Major control devices consist of a vacuum actuated switch, a pressure actuated switch, and an oxygen monitor in conjunction with an analog or digital controller. All major control devices remotely monitor the activity within the plastic bag-like container. Secondary control devices may consist of relays, switches and in some instances, timers.

It is to be understood that the invention is not to be limited to the preceding, but may be modified within the scope of the appended claims.

I claim:

1. A device for charging a flexible receptacle containing deteriorative material with an inert gas comprising, in combination, a nozzle adapted for insertion in the receptacle, a control unit, a source of inert gas and a pump; said nozzle having a plurality of fittings, said fittings being associated with sensors to determine gas content and pressure within the receptacle, said pump being operable to selectively pressurize or evacuate said receptacle, said pump being connected to said nozzle by a vacuum hose for removing oxygen therethrough and to a conduit connected to said inert gas source and to an inert gas charging hose for filling said receptacle with an inert gas, said control unit having electric connections with said sensors and said pump, said control unit including sensor-responsive switch means for selectively operating the pump in gas charging or evacuating operation.

2. The device of claim 1 wherein said control unit includes manual switch means for selectively overriding said sensor responsive switch means.

3. The device of claim 1, and a cart mounting said control unit, pump and gas source.

4. The device of claim 1 wherein said inert gas is one of the class including Nitrogen, Xenon, Argon, Radon, Krypton and Neon.

5. A device for producing a substantially non-oxidizing atmosphere within a receptacle which encloses one or more objects normally subject to oxidation, comprising a nozzle adapted for insertion in the receptacle, a control unit, a source of inert gas, a pump, said nozzle having a plurality of fittings, a sensor associated with each nozzle fitting and responsive to the content of a selected gas within the receptacle, said pump being operable to selectively reduce atmospheric gas volume in said receptacle or to supply inert gas to said receptacle, an evacuating hose connecting one fitting of said nozzle with said pump, a second conduit connecting a second fitting of said nozzle with said pump and said source of inert gas, said control unit having electric connections with said sensors and said pump and including sensor-responsive switch means, said control unit sequentially operating said pump in receptacle-evacuating and inert-gas-charging functions in response to said sensors.

6. A device as defined in claim 5, wherein said receptacle is formed of flexible gas-impervious sheet material.

7. A device as defined in claim 5, wherein said inert gas charge is supplied in quantity sufficient to protect said receptacle-enclosed objects from rusting.

8. A device as defined in claim 5, wherein said pump is reversible in response to said sensor-responsive switch means.

* * * * *